United States Patent [19]

Spohr

[11] 4,338,164

[45] Jul. 6, 1982

[54] METHOD FOR PRODUCING PLANAR SURFACES HAVING VERY FINE PEAKS IN THE MICRON RANGE

[75] Inventor: Reimar Spohr, Darmstadt, Fed. Rep. of Germany

[73] Assignee: Gesellschaft für Schwerionenforschung GmbH, Darmstadt, Fed. Rep. of Germany

[21] Appl. No.: 219,350

[22] Filed: Dec. 22, 1980

[30] Foreign Application Priority Data

Dec. 20, 1979 [DE] Fed. Rep. of Germany ..... 2951287

[51] Int. Cl.[3] ..... C25D 1/20; C25D 5/54

[52] U.S. Cl. ..... 204/4; 204/12; 204/32 R

[58] Field of Search ..... 204/3, 4, 6, 9, 11, 204/12, 30, 32 R, 38 B

[56] References Cited

U.S. PATENT DOCUMENTS 3,922,206 11/1975 Thackray ..... 204/6
4,153,654 5/1979 Maffitt ..... 204/6

OTHER PUBLICATIONS

Spindt et al., "Physical Properties of Thin Field Emission Cathodes with Molybdenum Cones," Journal of Applied Physics, vol. 47, No. 12, Dec. 1976, pp. 5248-5263.

Thomas et al., "Fabrication and Some Application of Large-Area Silicon Field Emission Arrays", Solid State Electronics, vol. 17, 1974, pp. 155-163.

*Primary Examiner*—T. Tufariello
*Attorney, Agent, or Firm*—Spencer & Kaye

[57] ABSTRACT

A method for producing planar surfaces having very fine peaks in the micron range or smaller, e.g. planar field emission cathodes, of conductive or semiconductive material, by filling cavities in a matrix. A sheet of the planar dielectric material is irradiated with high energy ions, e.g. from a heavy ion accelerator to form nuclear traces therein, and is subsequently subjected to an etching process to expose the nuclear traces. Thereafter, the hole-like nuclear traces or cavities are filled with conductive or semiconductive material and one surface of the sheet of planar material is covered, at the open ends of the nuclear traces or cavities, with a coating of likewise conductive or semiconductive material. If desired the matrix of planar material may subsequently be removed.

12 Claims, 9 Drawing Figures

2000:1

2000:1

8000:1

METHOD FOR PRODUCING PLANAR SURFACES HAVING VERY FINE PEAKS IN THE MICRON RANGE

BACKGROUND OF THE INVENTION

The present invention relates to a method for producing planar surfaces having very fine peaks in the micron range or smaller, for example, planar field emission cathodes, of conductive or semiconductive material, by filling cavities in matrices of dielectric material and, if desired, subsequently removing the matrix containing the cavities.

The method under discussion here relates to the manufacture of the very finest metal, i.e. conductive, needles of a given length and orientation in a large number of dielectric materials. It is possible in this connection for the metal needles to either remain in the dielectric material, e.g. when they are used for embedded dipole antennas for the infrared wave art, or to be exposed, for example, for use in field emission peaks or large-area field emission cathodes. For this case, a metallic base is required to hold a plurality of metallic peaks in the form of a bed of needles.

In the prior art, individual, freestanding field emission peaks have been produced by electrolytically sharpening the point of a fine wire, usually a tungsten wire. The field emission peak is introduced into a high vacuum. If the tensile stresses are relatively low, very high and simultaneously very well bundled electron beams can be obtained from such field emission peaks to be used, for example, in grid electron microscopy. In the prior art, large area arrangements of many field emission peaks have been produced according to methods customary in the semiconductor art, i.e. covering with a mask, subsequent wet chemical etching or ion etching, as well as oblique vapor-deposition. However, this prior art method is able to furnish a uniform arrangement of field emission peaks over a total area of only a few $cm^2$ with a density of up to about $10^5/cm^2$.

Such methods for producing field emission surfaces are very costly. Several process parameters must be optimized and the process includes a series of different, complicated process steps.

SUMMARY OF THE INVENTION

It is now the object of the present invention to provide a manufacturing process for a material having a surface, which exhibits a very low effective electron work function. Such a surface is constituted by an area having very many fine peaks, e.g. a bed of needles, as it was impossible to produce with prior art methods.

The above object is achieved according to the present invention now by means of a process of the above-mentioned type in which a sheet or solid body of planar dielectric material is irradiated with high energy ions, e.g. from a heavy ion accelerator, to provide same with latent nuclear traces; the nuclear traces are exposed in a subsequent etching process; and thereafter the exposed hole-like nuclear traces or cavities are filled with conductive or semiconductive material and, finally, one major planar surface of the planar material is coated, at the open ends of the nuclear traces or cavities with a coating of likewise conductive or semiconductive material. Depending on the ultimate use of the thus formed device the dielectric material matrix may thereafter be removed or left in place.

A method according to the invention which is particularly advantageous for producing a desired surface of copper with the aid of a mica matrix now comprises the following process steps:

I. Irradiating a solid planar mica body with heavy ions of sufficient energy and in a given quantity to produce a desired distribution of nuclear traces in the mica body;

II. Etching of the mica body to expose and open the latent nuclear traces to the desired hole diameter;

III. Vapor depositing a gold layer onto one major surface of the etched-open solid mica body;

IV. Contacting the vapor-deposited gold layer with platinum wire and covering the layer and wire with an insulating foil;

V. Immersing the solid body into a copper electrolyte bath;

VI. Electrolytically depositing copper onto the solid mica body to fill the exposed hole-like nuclear traces and cover the uncontacted major surface by applying a direct voltage across the bath;

VII. Mechanically removing the covering foil, the contacting wire and the gold layer; and VIII. Removing the solid mica body by etching in hydrofluoric acid.

If the resulting copper bed of needles is intended to remain in the solid mica body, step VIII may be omitted.

DETAILED DESCRIPTION OF THE PREFERRED EMBODIMENTS

Figure 1:
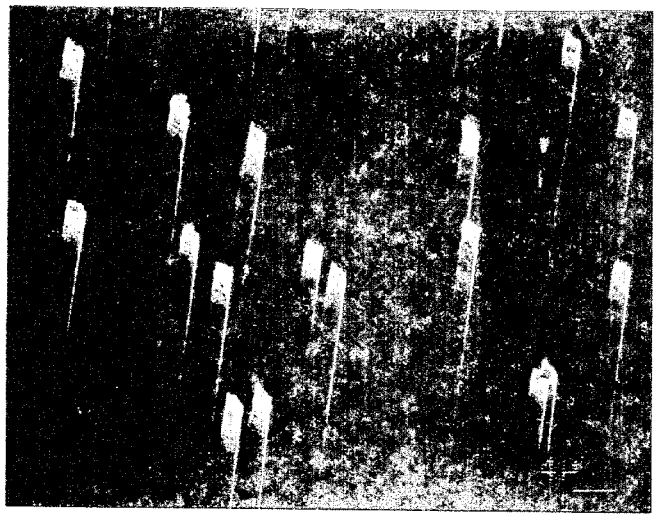
FIG. 1 is a photograph showing the fine peaks of a surface, i.e. a field emission cathode, produced with the aid of an irradiated mica matrix at an enlargement of >2000:1.
Figure 2:
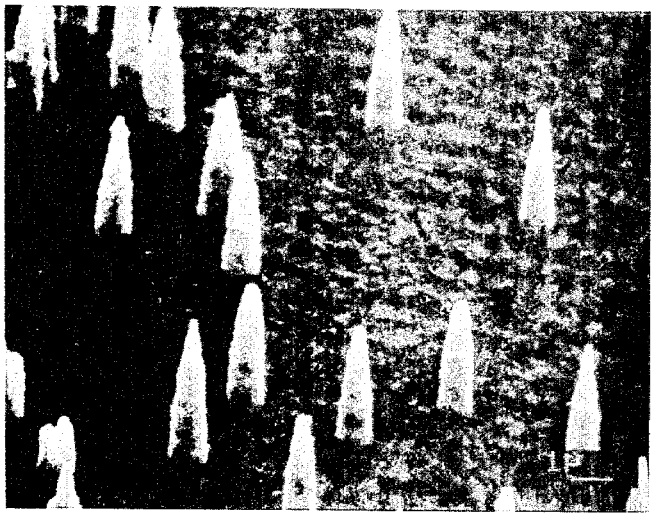
FIG. 2 is a photograph showing the field emission peaks produced on a surface with the aid of an irradiated polystyrene foil matrix at an enlargement of >8000:1.

The method according to the invention, as briefly described above, makes possible the manufacture of large-area field emission cathodes having individual peaks which are statistically distributed over its surface at a very high density, with selectable orientation, length and shape of the peaks or needles. Suitable materials for this purpose are a plurality of electro-chemically depositable metals and also nonmetals such as semiconductors. Deposition of electro-chemically unprocessable metals and nonmetals is effected, in particular, by way of deposition from the gaseous phase or deposition from the liquid phase, respectively. Suitable materials are e.g., metals such as copper, nickel and gold which can be easily deposited electrolytically non-metals such as silicon, silicon dioxide which can be deposited by chemical vapor deposition, ion activated or heat activated FIG. 1 shows a field emission cathode having very fine peaks in the form of a bed of needles as it can be produced from a mica nuclear trace filter. Alternatively, according to the embodiment shown in FIG. 2, a surface with the desired field emission peaks is produced using nuclear trace channels formed in a polystyrene foil upon which is deposited a copper layer from the aqueous phase and by subsequently dissolving the polystyrene by means of a suitable organic solvent. Since the material for field emission cathodes is usually tungsten—mainly because of its very good thermal capatibility—the deposition of tungsten seems to be of particular interest. According to the method, a tungsten precipitate can be obtained by deposition from the gaseous phase in that tungsten from a gaseous tungsten compound is precipitated onto a heated nuclear trace substrate and is subsequently removed or etched away from the matrix, so that such nuclear trace matrices can possibly be used several times.

Figure 3:
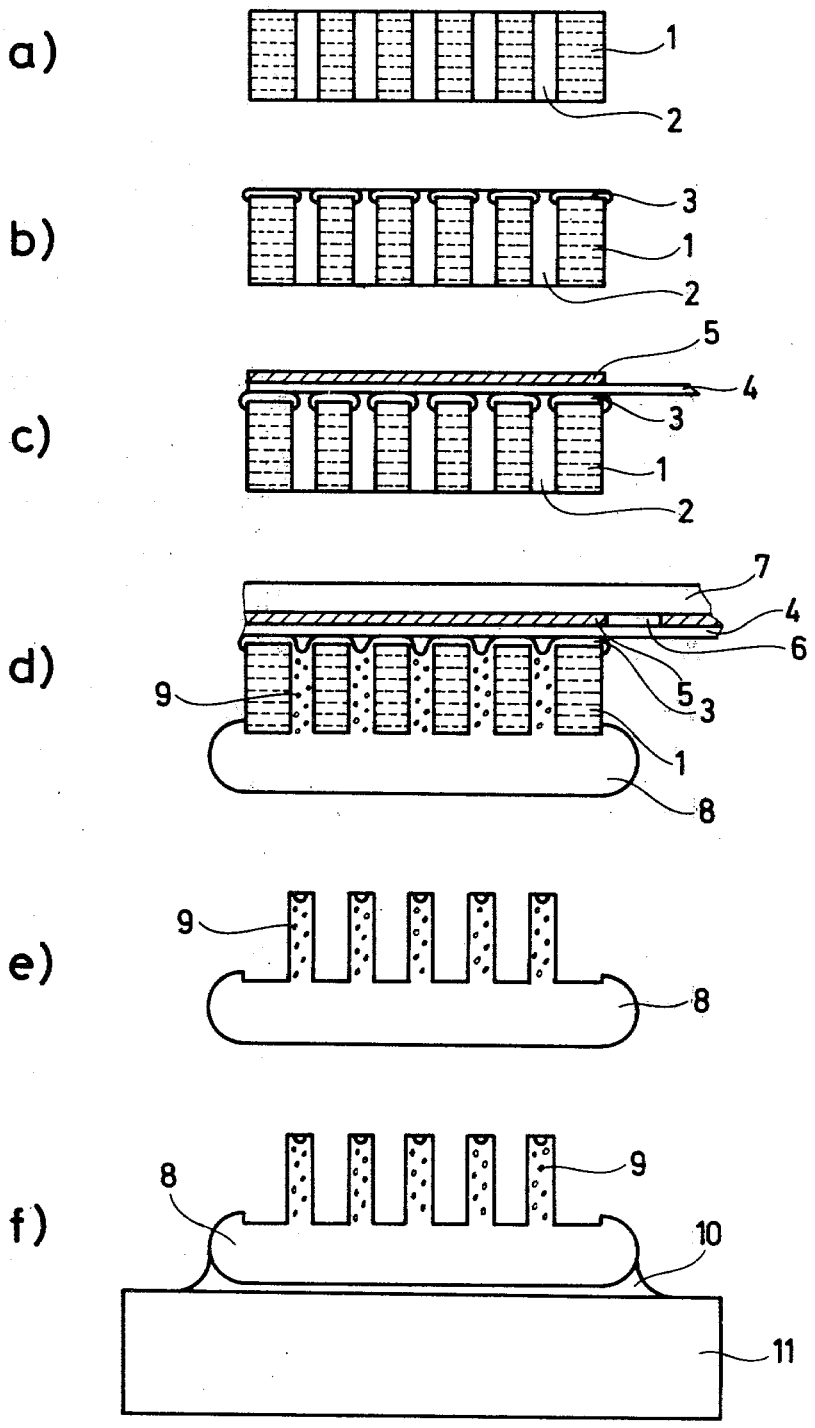
FIG. 3, in its views (a) through (f), schematically shows the individual manufacturing steps for producing the peaks according to FIG. 1 starting with an etched nuclear trace filter, through electro-chemical deposition and finally to production of the metallic imprint in the form of a fine bed of peaks or needles.

The individual process steps as they are shown schematically in FIGS. 3(*a*) through 3(*f*) respectively for the production of a copper cathode, by means of a mica matrix now are performed in the following sequence (a) A solid planar body of mica is irradiated in a conventional manner with heavy ions, e.g. in a heavy ion accelerator, of sufficient energy and in a given distribution to produce a desired distribution of latent nuclear traces in the mica body, and then the body is etched to expose and open the nuclear traces to form microholes. The resulting etched nulcear trace filter 1, which has been provided with the microhole 2, is cleaned and dried. Such forming of holes by etching of randomly directed nuclear tracks in solids generated by bombarding with uranium fission fragments is described in Fleischer R. L., Price P. B., Walker R. M.: "Tracks of Charged Particles in Solids" SCIENCE, July 23, 1965, Vol. 149, No. 3682.

(b) A thin layer of gold 3 is vapor-deposited onto one major surface of the planar mica body, i.e. the filter 1.

(c) The surface of the nuclear trace filter 1 onto which the gold layer 3 has been vapor-deposited is contacted by means of a platinum wire 4 and is then covered with an insulating foil 5.

(d) The arrangement prepared in this manner is immersed into an electrochemical copper bath and polarized to serve as cathode. A copper metal dot serves as the anode. The platinum wire 4 is connected with the auxilliary electrode 7 by means of a conductive silver contact 6 which penetrates the foil 5. The bath is operated at such a current that the current density in the nuclear trace channels is sufficiently low to prevent the inclusion of gaseous hydrogen which would make the needles brittle. The electrochemical process now deposits the metal layer 8, i.e. the copper, on the exposed major planar surface of the nuclear trace filter 1 so that the copper "grows" into the microholes 2 in the form of needles 9 and fills same. The current should have preferably a density of 0.05 Amp/cm$^2$ for highly conductive electrochemical baths.

(e) Subsequently, foil 5, wire 4 and gold layer 3 are removed by pulling them away and the nuclear trace filter material 1 is removed by dissolving it, e.g. in hydrofluoric acid. This leaves the metal layer 8 with the needles or peaks 9, respectively. If the needles are to remain embedded in the matrix 1, process step (e) may also be omitted.

(f) The finished copper imprint 8 with the bed of needles or peaks 9, is fastened, by means of a layer of silver 10, onto the surface of sample plate 11 for further use.

In summary, the significant novelty and advantages of the present invention are now as follows The nuclear trace technique is used for the first time to produce positive, i.e. convex structures. The area of a field emission cathode produced in this manner can be made very large, keeping the electron work function very low.

The number of field emission peaks corresponds exactly to the number of nuclear traces present in the original nuclear trace matrix and may be very large, i.e. $>10^6/cm^2$. The shape, direction as well as the quantity of such field emission peaks can be set very precisely and, in the case of the transilluminated original, corresponds precisely to the thickness of the original. In the case of the non-transilluminated original it corresponds to the length of the nuclear trace which is delimited by its expanse in the material in a planar orientation. A specific example of the method according to the invention is:

Matrix: 50 μm thich 50 mm diameter mica
Irradiation: $10^6$ ions per cm$^2$ Uranium ions of 7 MeV/-nucelon
Etching: 1 hour 40% HF, at room temperature
Hole diameter: Approximately 1–2 μm
Deposition processes:
(a) deposition of a conductive gold film (100 ng/cm$^2$) on one side of the sample.
(b) contacting of gold film with a wire.
(c) convering of the gold coated surface with an insulating material (10 μm adhesive insulating foil).
(d) inserting into the electrochemical copper bath.
(e) deposition of metal (4–5 hours at a current density of about 10 mA/cm$^2$).
(f) removal of the bath.
(g) removal of insulator, contact, and gold
(h) removal of matrix e.g. in 40% HF, 1 hours at room temperature The area of the needle bed corresponds to the irradiated area, and the density corresponds exactly to the density of irradiation (here $10^6$ needles/cm$^2$). The diameter of the needles corresponds exactly to the hole diameter (here about 1–2 μm).

A semiconductor material such as Silicon can be deposited from a mixture of $SiF_4$ and $H_2$ in an ion activated chemical vapor deposition process.

It is to be understood that the above description of the present invention is susceptible to various modifications, chantes and adaptations, and the same are intended to be comprehended within the meaning and range of equivalents of the appended claims.

What is claimed is:

1. Method for producing a planar surface of conductive material having very fine peaks in at most the micron range of conductive material conductively connected thereto, comprising the steps of: irradiating a sheet of planar dielectric material, which is to serve as a matrix, with a beam of parallel high energy heavy ions to form a plurality of nuclear traces of the same length in the dielectric material with the density and parallel orientation of the irradiation, and thus of said nuclear traces, corresponding to the desired density and orientation of peaks on the planar surface; subsequently etching said sheet of dielectric material to expose said nuclear traces and form hole-like cavities with diameters in the micron range; and filling said hole-like cavities with conducting material and covering one of the major surfaces of said sheet of planar dielectric material with the open ends of said cavities with conductive material to connect together the conductive material filling said hole-like cavities.

2. The method defined in claim 1 further comprising removing the matrix of dielectric material.

3. A method as defined in claims 1 or 2 wherein said step of filling includes depositing a metal onto said sheet of planar dielectric material to fill said cavities and cover said one surface of said sheet of planar dielectric material.

4. A method as defined in claim 3 wherein said metal is electrochemically deposited.

5. A method as defined in claim 4 wherein said metal is copper and said dielectric material is mica.

6. A method for producing a copper planar surface having very fine peaks in the micron range or smaller with the aid of a mica matrix comprising the steps of:

irradiating a solid mica body having a planar major surface with accelerated heavy ions of sufficient energy and in a given quantity to produce a desired distribution of latent nuclear traces in said body;

etching the solid mica body to expose and open the latent nuclear traces to the desired hole diameter;

vapor-depositing a gold layer on the major surface of said etched-open solid mica body which is opposite said planar major surface;

contacting said vapor-deposited gold layer with a platinum wire and covering said gold layer and said wire with an insulating foil;

immersing said solid body in a copper electrolyte bath;

electrolytically depositing copper on said solid mica body to fill said exposed nuclear traces and cover said planar major surface by applying a direct voltage across said bath; and mechanically removing said insulating foil, said platinum contacting wire and said gold layer.

7. A method as defined in claim 6 further comprising thereafter removing said mica body by etching in hydrofluoric acid.

8. A method as defined in claim 1 or claim 6 wherein said step of irradiating is carried out by means of a heavy ion accelerator.

9. A method as defined in claim 2 or claim 7 wherein said step of irradiation includes irradiating with high energy heavy ions of a density of at least $10^6$ ions per $cm^2$.

10. A method as defined in claim 1 or claim 6 wherein said step of irradiating includes directing the heavy ions onto said major surface in a direction so as to produce nuclear traces which are substantially perpendicular to said major surface.

11. A planar field emission cathode produced according to the method of claim 2 or claim 7.

12. A planar field emission cathode produced according to the method of claim 9.

* * * * *